United States Patent [19]

Rhee

[11] 4,378,230

[45] Mar. 29, 1983

[54] METHOD FOR IMPROVING FUEL EFFICIENCY

[76] Inventor: Eun B. Rhee, 333-53 Sindang-Dong, Chung-Ku, Seoul, Rep. of Korea

[21] Appl. No.: 851,175

[22] Filed: Nov. 14, 1977

Related U.S. Application Data

[63] Continuation-in-part of Ser. No. 755,169, Dec. 29, 1976, abandoned.

[30] Foreign Application Priority Data

Dec. 31, 1975 [KR] Rep. of Korea ..... 2901

[51] Int. Cl.[3] ..... C10L 1/32

[52] U.S. Cl. ..... 44/51

[58] Field of Search ..... 44/51

[56] References Cited

U.S. PATENT DOCUMENTS 1,440,356 12/1922 Morrell ..... 44/51

1,926,071 9/1933 Vance ..... 44/51

2,920,948 1/1960 Weeks ..... 44/51

OTHER PUBLICATIONS

The Condensed Chemical Dictionary, 8th Ed., p. 269, Copyright 1971.

Organic Chemistry, Morrison & Boyd, p. 1070, paragraph 34.1, 3rd Edition, May 1974.

*Primary Examiner*—Charles F. Warren

*Assistant Examiner*—Y. Harris-Smith

*Attorney, Agent, or Firm*—Armstrong, Nikaido, Marmelstein & Kubovcik

[57] ABSTRACT

This invention discloses a method for improving fuel economy and at the same time reducing pollutants caused by the use of oil as a fuel, which comprises combusting said oil in the form of an oil-water emulsion, in which said oil-water emulsion is effected by admixing a mixture comprising oil and water with dextrin.

7 Claims, No Drawings

METHOD FOR IMPROVING FUEL EFFICIENCY

CROSS-REFERENCE TO RELATED APPLICATION

This application is a continuation-in-part of my earlier filed copending application Ser. No. 755,169, filed Dec. 29, 1976, now abandoned.

This invention relates to an improvement in fuel oils, more particularly to a method for improving fuel economy and at the same time reducing pollutants caused by the use of oil as a fuel.

BACKGROUND OF THE INVENTION

Petroleum is one of man's most significant sources of energy. A multitude of petro-chemical products have enriched or rather made possible the civilized life of mankind in the present century. Hence, the demand of petroleum can be expected to be on the rise in the foreseeable future.

The estimated amount of oil deposits in the world are limited and geographical distribution is highly uneven. As demonstrated in the oil crises of 1973, quantity supplied and price charged may be fixed at the whim of oil-producing regions. One of the first items on the agenda facing mankind is the development of new sources of energy. Indeed, any device to economize the consumption of oil is welcome.

In view of these circumstances, the present invention provides one such oil-saving means, the point of which is to add water to fuel oil. The idea has originated from widely-observed phenomena; for example, pulverized coal yields more heat as it burns when mixed with a small amount of water, and fuel is sprayed with water in order to produce more efficient combustion in the melting furnace of iron works and in a jet engine at the take-off of an aircraft.

Oil and water do not mix in the natural state because of differences in their interfacial tension and in specific gravity. Polymeric substances such as gum arabic, vegetable gelatine, polyalcohol and the like are known as emulsifying agents for oil and fats in general. However, they are found to be inadequate for mixing oil and water. An ultrasonic reactor has been successfully used to create an emulsion of 70 percent oil and 30 percent water. This emulsion has been found to produce more heat and at the same time reduce polluants to a greater extent (See Newsweek, June 14, 1974). But ultrasonic emulsification are rather costly to install and operate. Furthermore, the resulting emulsion leaves much to be desired, in terms of stability and permanence.

SUMMARY OF THE INVENTION

An object of the present invention is to provide a process for preparing emulsified fuel oil at minimum cost with a simple and economical emulsification apparatus. Another object of the invention is to provide a chemical emulsifying agent enabling water and oil to mix each other to afford an oil-water emulsion suitable for use as a fuel. Still another object of the invention is to provide a method for improving combustion efficiency of fuel oils. A further object of the invention is to provide a method for improving fuel economy of oil. A still further object of the invention is to provide a method for reducing polluants caused by the use of oil as a fuel. Still another object of the invention is to provide an emulsified oil-water composition suitable for use as a fuel, in which said composition can be prepared by a simple and economic emulsification apparatus and has high stability and permanence.

Since the resulting emulsion is to be used as fuel, a satisfactory relationship between fuel economy and efficient combustion must be taken into account. The optimum proportion of water may be much lower than that of oil, because, as well known in general, the interfacial tension of oils is not only higher than that of water but also the specific gravity thereof is lower than that of water so that water positions below oil in oil-water mixture. Therefore, in the emulsifying process, water must be separated into fine particles which are dispersed evenly in oil so that an emulsion of water-in-oil type (W/O type) is obtained.

A simple blender or a colloidal state in order to assure stability in the face of moderate changes in temperature and permanence over a considerable lapse of period. For such purposes, the present invention requires an emulsifying agent which is more efficient to emulsify oil with water.

DESCRIPTION OF THE PREFERRED EMBODIMENTS

In accordance with the present invention, it has been discovered that dextrin is a highly satisfactory emulsifying agent. Dextrin is easily soluble in cold water and has a high degree of dispersion. Moreover, dextrin has low viscosity, high fluidity, strong adhesivity and low gelatinity, thereby making it ideal for the purpose of the present invention.

In one embodiment of the present invention, the desired emulsified fuel is prepared by adding dextrin in an amount of about 0.5 to about 15 parts by weight per 1000 parts by weight of $\geqq 35:\leqq 65$ water-oil mixture and admixing the mixture by means of an emulsification apparatus. In this case, if the portion of dextrin is less than 0.5/1000 parts of oil-water mixture, the stability of the resulting emulsion is notably reduced; on the other hand, if more than 15/1000 parts of oil-water, the degree of dispersion of dextrin is also decreased accordingly and the fluidity thereof becomes fragible. At the same time, in case of the latter, a coagulation makes the emulsion inferior as well as inadequate in passing through the orifice of burner. Therefore, it has been found that the appropriate amount of dextrin to be added to the mixture of water and oil should be within about 0.5/1000 and about 15/1000 parts by weight in relation to the corresponding oil-water mixture.

Of course, the amount of dextrin to be added depends on the proportion of oil and water in the oil-water mixture. For example, in 20:80 water-oil mixture, the amount of dextrin needed is about 2 to about 3 parts by weight per 1000 parts by weight of the mixture, whereas in 30:70 water-oil mixture, the desired amount of dextrin is about 4 to 8 parts by weight per 1000 parts by weight of the mixture.

An emulsion of W/O type containing the aforementioned amounts of dextrin can maintain its inherent state as long as 15 months. In contrast, when starch is used in place of dextrin with using various added proportions, it fails to produce an emulsion of water in oil.

In accordance with the present invention, it has been found that a mixture having a proportion of water to oil in a 35:65 ratio is satisfactory. However, if the proportion is varied to contain over 35 parts of water or less than 65 parts of oil, the heating value of the fuel is decreased considerably. Furthermore, as the proportion approaches 50:50, combustion is no longer possible. From the foregoing, it can be noted that the appropriate ratio of water to oil in the emulsion is 30 percent or less water or 70 percent or more oil. The preferred ratio is 20 percent or less water or 80 percent or more oil. However, it should be understood that the mixed proportion more or less depends on the type of oil to be used, that is, the use of heavy or light oil.

It has been found that the emulsion of the present invention is suitable for use as a fuel. When used as such, the emulsion of the present invention, for example, an emulsion of water in Bunker-C oil, produces more heat than does un unemulsified oil.

It has been further found that the use of the emulsion of the invention results in a substantial savings of fuel. A still further finding is that the exhaustion of toxious pollutants can be greatly reduced in burning the emulsion of the present invention.

The following examples are set forth to further illustrate the invention but are not intended to limit the scope of the invention.

EXAMPLE 1

Comparison of the Fuel Efficiency in a 7-Ton Boiler

Fuel efficiency tests were carried out in a 7-ton boiler. Before feeding into the boiler Bunker-C oil or the Bunker-C oil-water emulsion, the temperature inside the boiler was maintained at a temperature of between 800° and 1000° C. For this purpose, diesel oil was burned for more than one hour before feeding the test fuels. The feeding temperature of the test fuel was maintained at 80°-90° C., while the feeding temperature of water into the boiler was 15° C.

| | Bunker-C Oil* | Emulsified Fuel (water = 19% B.C oil = 81%)** | Emulsified Fuel (water = 26% B.C oil = 74%)*** |
|---|---|---|---|
| Fuel Consumption | 4,513 1 (100) | 5,086 1 (113) | 2,447 1 |
| Bunker-C Oil Consumption Net of Water | 4,513 1 (100) | 4,219 1 (93) | 1,810 1 (40) |
| Steam Generated | 55,013 1 (100) | 58,989 1 (100) | 28,038 1 |
| Bunker-C Oil Consumed per Liter of Steam Generated | 0.08 1 (100) | 0.07 1 (87.5) | 0.06 1 (75) |
| Amount of Steam Generated per Liter of Fuel Consumed | 12.18 1 (100) | 13.98 1 (115) | 15.49 1 (127) |

*Bunker-C oil from Kuwait crude
**2 parts of dextrin added per 1000 parts of the mixture
***4 parts of dextrin added per 1000 parts of the mixture

EXAMPLE 2

Comparison of the Fuel Efficiency in a 1-Ton Boiler

The tests were carried out by the method as described in Example, except that a 1-ton boiler in place of a 7-ton boiler was used. Two separate runs were carried out for the emulsion comprising 30.4% water and 69.6% Bunker-C oil, in which the emulsion was effected by the addition of 5 parts of dextrin to 1000 parts of the oil-water mixture.

| | Bunker-C Oil | Run 1 Emulsified Fuel (water = 30.4% B.C. Oil = 69.6%) | Run 2 Emulsified Fuel (water = 30.4% B.C. Oil = 69.6%) |
|---|---|---|---|
| Fuel Consumption | 92.5 liter (100) | 153.3 liter (166) | 141.7 liter (153) |
| Bunker-C oil Consumption Net of Water | 92.5 liter (100) | 107 liter (116) | 99 liter (107) |
| Steam Generated | 1140 liter (100) | 1477 liter (130) | 1381 liter (121) |
| Bunker-C oil Consumed per Liter of Steam Generated | 0.08 (100) | 0.07 (87.5) | 0.07 (87.5) |
| Steam Generation per Liter of Bunker-C Oil | 12.3 liter (100) | 13.8 liter (112) | 13.9 liter (113) |
| Thermal Efficiency* | 44.84% (100) | 52.81% (118) | 53.44% (119) |
| Total Heat Index of Steam | 100.00 | 80.43 | 81.39 |
| Net Bunker-C Oil Equivalent Heat Index | 100.00 | 114.90 | 116.27 |
| Fuel Economy | — | 15% Improved | 16% Improved |

*Thermal efficiency of fuel shown herein is accounted for by the combustion heat of fuel, the sensible heat of fuel, air and feed water, the total heat of steam and discharge gas, and the waste heat.

EXAMPLE 3

Comparison of Pollutants Exhausted

A 28% water and 72% Bunker-C oil emulsion is compared with unemulsified Bunker-C oil for the extent of sulfur dioxide and carbon monoxide exhausted when being burnt in a 1-ton boiler under the same conditions. The text emulsified fuel is prepared by adding 4 parts of dextrin to 1000 parts of the oil-mixture.

| 100% Bunker-C Oil* | | | Emulsion of 28% Water/ 72% Bunker-C Oil | | |
|---|---|---|---|---|---|
| Feed Amount of Water | $SO_2$ | CO | Feed Amount of Water | $SO_2$ | CO |
| 1.00 | 553.6 ppm | 500 ppm | 0.80 | 206.9 ppm | nil |
| 1.25 | 568.2 ppm | 520 ppm | 1.00 | 305.5 ppm | 120 ppm |
| 1.50 | 568.2 ppm | — | 1.50 | 384.4 ppm | 145 ppm |

*Bunker-C oil from Kuwait crude

What is claimed is:

1. A method for saving bunker-c oil for use as a fuel and reducing pollution caused by the use thereof, which comprises combusting said bunker-c oil in the form of an oil-water emulsion, wherein said oil-water emulsion is effected by admixing a mixture comprising 65% or more oil and 35% or less water with dextrin; said dextrin being added in an amount of between about 0.5 and about 15 parts by weight per 1000 parts by weight of said mixture.

2. The method of claim 1 in which said mixture of oil and water comprises 80 percent or more oil and 20 percent or less water.

3. A method for increasing heat efficiency of bunker-c oil for use as a fuel and reducing pollution caused by the use thereof, which comprises combusting said oil in the form of an oil-water emulsion, wherein said oil-water emulsion is effected by admixing a mixture comprising 65 percent or more oil and 35 percent or less water with dextrin; said dextrin being added in an amount of between about 0.5 to about 15 parts by weight per 1000 parts by weight of said mixture.

4. The method of claim 3 in which said mixture of oil and water comprises 80 percent or more oil and 20 percent or less water.

5. A method for reducing pollution caused by the use of bunker-c oil as a fuel and reducing pollution caused by the use thereof, which comprises combusting said oil in the form of an oil-water emulsion, wherein said oil-water emulsion is effected by admixing a mixture comprising 65 percent or more oil and 35 percent or less water with dextrin; said dextrin being added in an amount of between about 0.5 and about 15 parts by weight per 1000 parts by weight of said mixture.

6. The method of claim 5 in which said mixture of oil and water comprises 80 percent or more oil and 20 percent or less water.

7. An emulsified oil composition suitable for use as a fuel to reduce pollution caused by the use of bunker-c fuel oil which comprises a mixture of 65 percent or more bunker-c oil and 35 percent or less water and about 0.5 to about 15 parts by weight of dextrin per 1000 parts by weight of said mixture.

* * * * *